United States Patent [19]

Smith

[11] 3,981,258

[45] Sept. 21, 1976

[54] WATERSKI SAILBOAT

[75] Inventor: Bernard Smith, King George, Va.

[73] Assignee: The United States of America as represented by the Secretary of the Navy, Washington, D.C.

[22] Filed: July 15, 1975

[21] Appl. No.: 596,118

[52] U.S. Cl. ..... 114/39; 114/56; 114/66.5 H; 114/123; 114/162

[51] Int. Cl.[2] ..... B63B 39/00

[58] Field of Search ..... 114/39, 66.5 R, 66.5 H, 114/121, 122, 123, 126, 162, 56; 280/213

[56] References Cited

UNITED STATES PATENTS

| | | | |
|---|---|---|---|
| 3,286,673 | 11/1966 | Nason | 114/66.5 H |
| 3,295,487 | 1/1967 | Smith | 114/39 |
| 3,870,004 | 3/1975 | Bailey | 114/39 |

FOREIGN PATENTS OR APPLICATIONS

| | | | |
|---|---|---|---|
| 705,162 | 3/1954 | United Kingdom | 114/39 |

*Primary Examiner*—Trygve M. Blix
*Assistant Examiner*—Charles E. Frankfort
*Attorney, Agent, or Firm*—R. Sciascia; R. Beers; S. Sheinbein

[57] ABSTRACT

A hydrofoil sailboat with a slender hull and a foil-shaped sail spaced laterally therefrom. The hull has one flat side facing the sail and one convex side. The sail is inclined from the vertical toward the hull and is supported at its base ends by a pair of freely swiveling waterskis. The hull supports a rudder at each of its ends, the rudders being hydrofoils with their flat sides facing the sail. The length-to-width ratio of the hull is no less than 5:1 and the inclination of the sail about 30° from the vertical.

11 Claims, 4 Drawing Figures

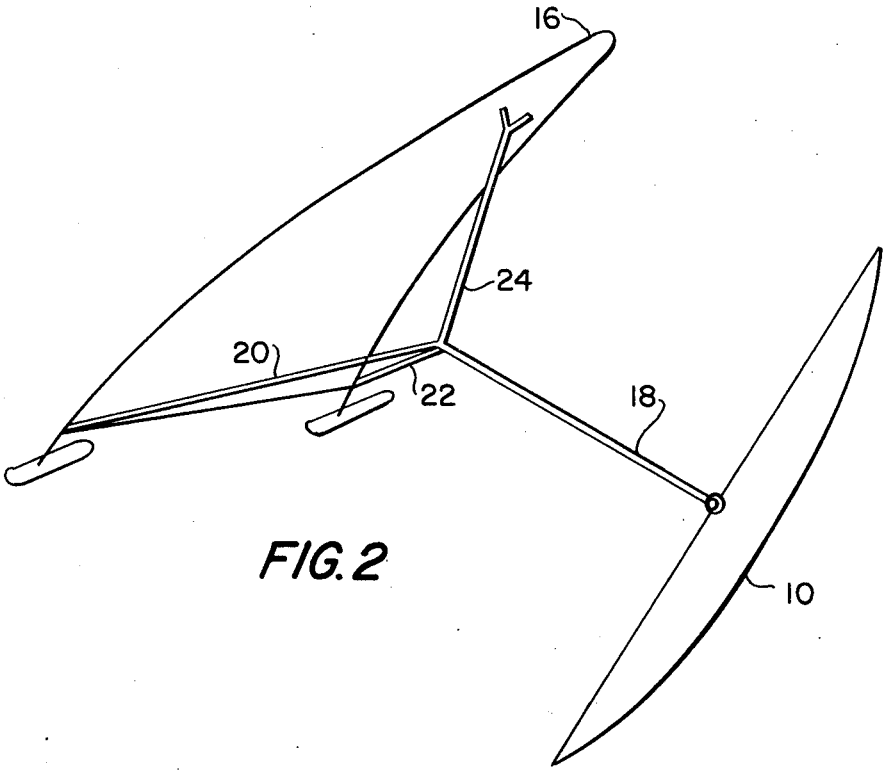
FIG. 2
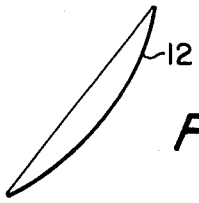
FIG. 3
FIG. 4
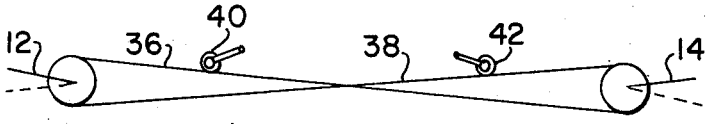

WATERSKI SAILBOAT

BACKGROUND OF THE INVENTION

This invention relates to high-speed sailboats and especially to a high-speed hydrofoil sailboat.

An excellent discussion on the structure, dynamic forces and controls of a particular type of aerohydrofoil sailboat is given by the inventor in a previous patent, U.S. Pat. No. 3,295,487, issued Jan. 3, 1967. The reader is referred to this patent, also, for a discussion of problems encountered in improving the speed of ordinary sailboats.

A high-speed, inexpensive, easily constructed sailboat would have use as a pleasure craft and as a moving naval gunnery and bombing target.

SUMMARY OF THE INVENTION

The objects and advantages of the invention are attained by a combination of features. The sailboat comprises a slender hull with one flat side; an inclined sail tilted toward the hull, tightly stretched to form an airfoil, and spaced laterally from the hull; rudders at each end of the hull with a hydrofoil shape; and freely swiveling waterskis supporting the sail above the water.

An object of this invention is to provide a hydrofoil sailboat which, in comparison to an aerohydrofoil, has greater speed in light winds, equal speed in strong winds, better ability to operate in shallow water and better load-carrying capability.

A further object is to provide an easily constructed, inexpensive, high-speed sailboat.

Other objects, advantages and novel features of the present invention will become apparent from the following detailed description of the invention when considered in conjunction with the accompanying drawing.

BRIEF DESCRIPTION OF THE DRAWING

FIG. 2 is a pictorial representation of the embodiment of FIG. 1, shown at different angle so that the spar framework configuration is more apparent.

FIG. 3 is a view showing a lateral cross-section through a ruddering foil.

FIG. 4 is a schematic of a control means for moving the ruddering foils.

DETAILED DESCRIPTION OF THE INVENTION

Figure 1:
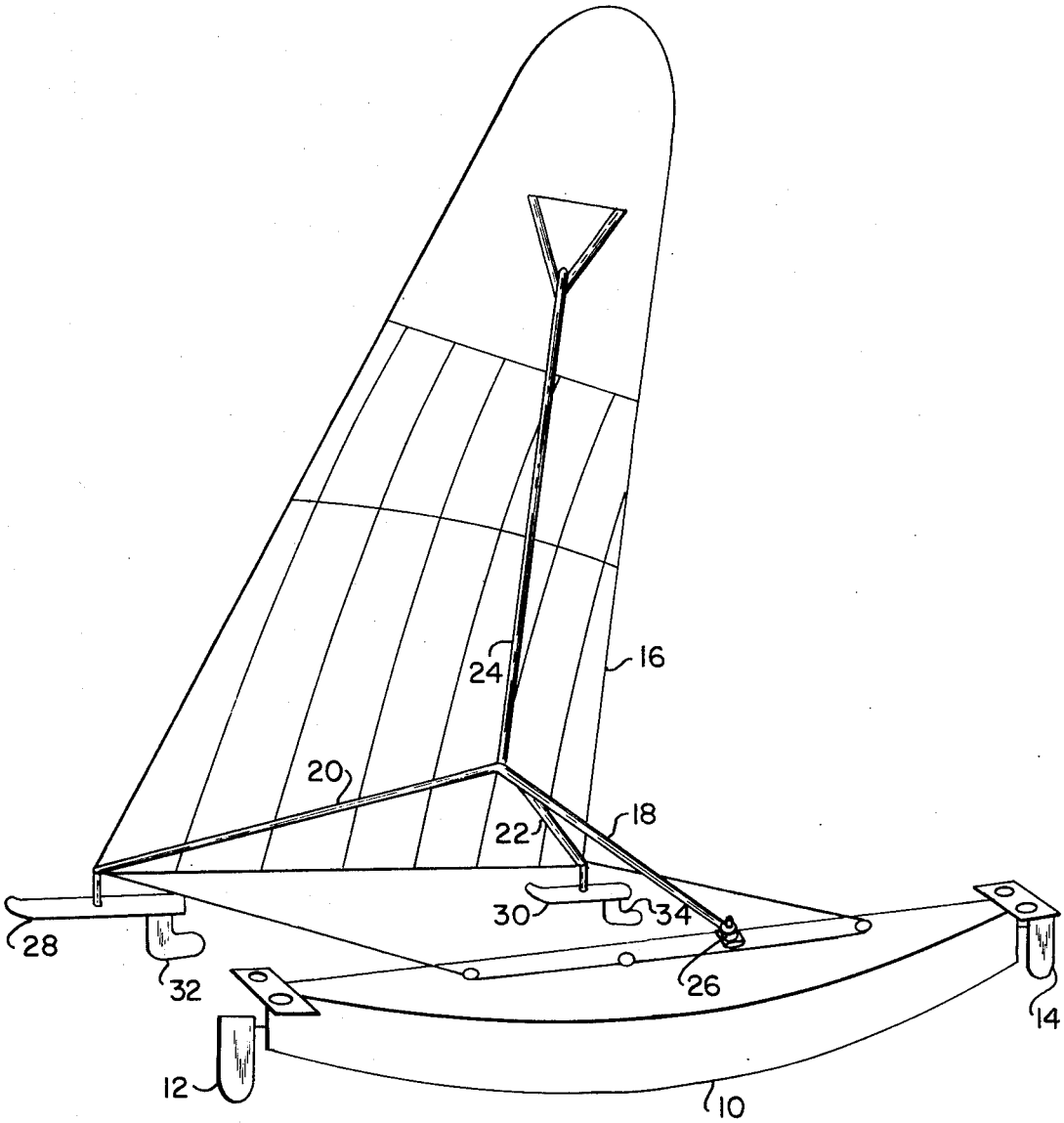
FIG. 1 is a pictorial representation of an embodiment of the invention.

FIG. 1 shows an embodiment of a sailboat built in accordance with the present invention. The boat has a hull 10 with a pair of ruddering foils 12 and 14, one at each end of the boat. The sail 16 is spaced from the boat and mounted at the end of a four-spar framework (spars 18, 20, 22, 24), the sail tilting toward the boat at an angle. The spar 18 is mounted on the boat with a swivel mount 26 which allows horizontal swiveling but not vertical movement of the spar. This arrangement allows the hull to yaw and pitch but prevents roll. The sail may be allowed to swing some 315° in azimuth, if desired, but only about 45° is necessary to sail the boat in any direction.

A freely swiveling waterski 28 and 30 is mounted on the spars at each end of the bottom of the sail. Each ski has a fin 32, 34 to keep the ski facing in the direction of motion of the boat. The skis support the sail.

The inclination of the sail is such as to eliminate all listing moments that would otherwise be produced. The optimum angle of inclination is about 30° from the vertical. The angle may vary 5° to 10° either way. If the angle is too great, driving power is lost; if too small, overturning moments develop. The angle of inclination can be controlled by a set of cables (not shown).

The boat hull, as can better be seen in FIG. 2, is flat on the side facing the sail 16 and convexly curved on the outside. The ruddering foils 12 and 14 (see FIG. 3) are similarly shaped. The curve is preferably circular. The sail can be a rigid wing or a tightly stretched fabric wing; it is also a foil.

The purpose of the special shape for the hull and rudders is to resist the side force produced by the sail while offering little drag to forward motion. Hydrofoil sections having a flat face for the high-pressure side achieve this result and are more efficient than, for example, sections that are curved symmetrically.

The hull 10 is a slender hull. In a typical embodiment, the length is 22 feet and the width is 1.5 feet. This is a ratio of about 15:1. It is not desirable to go to a ratio lower than 5:1 since, below this ratio, waves develop which limit the speed of the sailboat.

The distance of the sail from the hull in the above-mentioned embodiment is about 18 feet (about the same as the length of the root (base) of the sail). This distance relates to the angle of inclination of the sail. The relationship of all dimensions has to be such that the resultant force produced by the sail at the selected angle of inclination passes through the center of lateral resistance in the water. The intent is to avoid production of overturning moments.

FIG. 4 shows schematically a means for controlling the position of the ruddering foils 12 and 14. Cables 36 and 38 are crisscrossed on the deck of the boat, wound around cranks 40 and 42, respectively, and have their ends tied to the ruddering foils as indicated. Turning one crank will turn the other. When crank 42 is turned to bring foil 12 into the dashed position, the cables will bring foil 14 into the lower, dashed position, as shown. If one of the ruddering foils is moved upward (upward as seen in FIG. 4), the other will move upward by a corresponding angle. Any other suitable control system for the rudders may be employed.

A set of guy wires (not shown) is employed on the spars to hold them in proper relation to one another.

The sailboat, is placed in motion by turning the spar frame to which the sail is attached at an angle to the hull such that the resultant force from the sail provides a forward force component. The ruddering foils are used for directional control as the boat gets under way. Through the controls, the boat can be made to operate in either direction, thereby meeting requirements to move on opposite tracks. The skis support the outer extremities of the structure and with the ruddering foils and hydrofoil provided by the hull shape raise the boat at high speed, thereby reducing the immersion and resistance.

The compromises achieved in the invention give it speeds superior to other sailboats including the aerohydrofoil in light winds and speeds equal to the aerohydrofoil in high winds. This is combined with an ability to operate in shallower water and carry greater payloads than the aerohydrofoil.

Obviously, many modifications and variations of the present invention are possible in light of the above teachings. It is therefore to be understood that, within the scope of the appended claims, the invention may be practiced otherwise than as specifically described.

What is claimed is:

1. A hydrofoil sailboat comprising:

a slender hull one side of which is flat and the other side convexly curved to provide a hydrofoil shape to raise the sailboat at high speeds thereby reducing immersion and resistance;

at least one rudder on one end of said hull and means to control the angular movement of said rudder, said rudder being shaped with one flat side and one convexly curved side;

a sail, having the characteristics of an airfoil, spaced laterally from the flat side of said hull whereby said hull will resist side forces generated by said sail;

means for movably attaching said sail to said hull at an angle from the vertical so that the sail tilts toward the hull, the tilt of the sail being variable and the sail being movable in azimuth at least on one side of the hull; and waterski means attached at the bottom of the sail and supporting the sail.

2. A sailboat as in claim 1, wherein the length-to-width ratio of said hull is at least 5:1.

3. A sailboat as in claim 2, wherein the flat side of said rudder faces said sail.

4. A sailboat as in claim 2 having a second rudder similar to the first at the other end of the hull, said control means also controlling the movement of the second rudder.

5. A sailboat as in claim 2, wherein said means for movably attaching the sail to the hull comprises a light framework of spars.

6. A sailboat as in claim 2, wherein said sail is tilted about 30° from the vertical.

7. A sailboat as in claim 2, wherein said waterski means comprises at least two freely swiveling waterskis, each at one end of the base of the sail.

8. A sailboat as in claim 2, wherein said waterski means is mounted to be freely swiveling.

9. A sailboat as in claim 2, wherein the curves of the hull and the rudder are circular arcs.

10. A sailboat as in claim 1, wherein the dimensions of the spacing of the sail from the hull, the base of the sail and the inclination of the sail from the vertical are such that the resultant force produced by the sail at the selected angle of inclination passed through the center of lateral resistance in the water.

11. A sailboat as in claim 10, having a second rudder similar to the first at the other end of said hull, said control means also controlling the movement of the second rudder.

* * * * *